United States Patent [19]

Kreitz

[11] 4,015,452

[45] Apr. 5, 1977

[54] INTERRUPTING THE ROTARY MOVEMENT OF A GUIDE ROLLER

[75] Inventor: Hans Kreitz, Aachen, Germany

[73] Assignee: Fa. H. Krantz, Aachen, Germany

[22] Filed: Oct. 9, 1975

[21] Appl. No.: 621,058

[30] Foreign Application Priority Data

Nov. 2, 1974 Germany ..... 2452185

[52] U.S. Cl. ..... 68/175; 19/.25; 26/24; 68/177; 68/212; 226/26

[51] Int. Cl.[2] ..... D06B 3/28

[58] Field of Search ..... 226/25, 26; 68/175–178, 68/13 R, 205 R, 212, 181 R; 19/160, .25, .2, .23; 26/21, 24; 200/61.13, 61.14, 61.18

[56] References Cited

UNITED STATES PATENTS

| | | | |
|---|---|---|---|
| 704,704 | 7/1902 | Meats et al. | 19/.23 |
| 2,482,497 | 9/1949 | Miller | 226/26 |
| 2,866,232 | 12/1958 | West et al. | 19/.23 X |
| 3,235,932 | 2/1966 | Jones | 68/175 X |
| 3,728,878 | 4/1973 | Trullas | 68/13 R X |
| 3,890,547 | 6/1975 | Keck | 226/25 X |
| 3,911,702 | 10/1975 | Eckrodt | 68/177 |

FOREIGN PATENTS OR APPLICATIONS

| | | | |
|---|---|---|---|
| 954,709 | 6/1949 | France | 68/177 |

*Primary Examiner*—Philip R. Coe
*Attorney, Agent, or Firm*—Arthur B. Colvin

[57] ABSTRACT

This invention relates to an apparatus for interrupting the rotary movement of a drive roller for feeding a textile web and comprises a pivoted lever having a frame at one end with an opening through which passes the web driven by the roller. Positioned beneath the opening in the frame is a ring nozzle supplied with liquid under pressure to advance the web passing through the opening in the frame through a guide tube associated with the nozzle. A magnetic switch is provided in circuit with the drive means for the roller to effect stoppage of the rotation of the roller when the switch is actuated, a linkage being connected between the lever and the switch to actuate the latter when the lever is pivoted.

5 Claims, 3 Drawing Figures

INTERRUPTING THE ROTARY MOVEMENT OF A GUIDE ROLLER

BACKGROUND OF THE INVENTION

As conducive to an understanding of the invention it is noted that when a textile web is advanced through a treatment bath, such as a liquid in a tank, by a driven feed roller which advances the web into a ring nozzle which is supplied with liquid under pressure to advance the web through a guide tube, if the advance of the web through the treatment liquid should be interrupted while the feed roller is still advancing the web, the latter may wind around the feed roller even at relatively low speed with resultant need for stoppage of the system to eliminate the blockage due to the improper winding of the web around the roller.

The presently known devices for interrupting the rotary movement of a guide roller in case of trouble in the delivery of the textile material have all the disadvantage that at least one layer of the textile material must be wound on the guide roller before the rotary movement can be interrupted, for example, by shutting off the drive of the guide roller.

Textile material which is transported on the delivery side of a guide roller by means of a liquid current, as it is the case, for example, in soft-dyeing machines, can no longer be unwound from the guide roller, due to the tractive force expended by the liquor current in the wound state. Rather the known devices for interrupting the rotary movement of a guide roller also act as a lock pawl, so that a reversal of the direction of rotation of the guide roller is impossible. An automatic continuation of the rotary movement, after regulating the delivery of the textile material by means of the liquid current, is therefore not obtained. Instead, the textile material is usually damaged and can only be treated with great difficulties, for example, in a treatment in a closed apparatus under excess pressure, after this pressure has been relieved, for which it is naturally also necessary to lower first the temperature of the liquid treatment correspondingly. In addition to the complete interruption of the treatment process, opening of the apparatus and manual intervention are absolutely necessary.

The object of the invention is to provide a device for interrupting the rotary movement of a guide roller for textile material in web form which responds at the first sign of trouble in the delivery of the textile material so early that automatic repair of the defect is still ensured, after which the interruption of the rotary movement is eliminated immediately without the necessity of interrupting the treatment process or manual intervention.

According to the invention there is provided on one side of the guide roller a frame secured on a pivoted lever, which encloses the properly running textile material without touching it, the frame being connected to a switch.

In the device according to the invention, the frame enclosing the textile material in a normal run without touching it is so loaded by the textile material, at the slightest accumulation of textile material on the delivery side, which then no longer runs contact-free through the frame, that the lever performs a pivoted movement and actuates the switch to interrupt the rotary movement.

A particularly expedient design of the invention provides that a rod is articulated on the lever or frame, at the free end of which is arranged a permanent magnet opposite the switch designed as a magnetic switch.

The embodiment according to the invention can be used with particular advantage in pressure tanks where the contact-free magnetic switch can be arranged outside the tank, so that no openings are required in the tank for axles, pins, cabes etc., thus eliminating sealing problems. The lever with the frame and the articulated rod can be so arranged inside the tank by a low-friction bearing, for example, by means of an axle mounted on two points, so that the device is maintenance-free and insensitive to contamination by the treatment liquor.

According to another embodiment of the invention, the switch is arranged between a circuit for driving the guide roller or a circuit for actuating a brake. The invention takes into consideration the fact that it suffices for the interruption of the rotary movement of a driven guide roller to interrupt the circuit for driving the guide roller, while it is generally necessary for the rapid interruption of a non-driven roller to influence the circuit for actuating a brake in case of trouble so that the brake acts immediately as soon as the material begins to accumulate.

Finally, in another embodiment of the invention, the lever carries a displaceable weight on the side opposite the frame.

The displaceable weight permits the apparatus to be adjusted to the desired sensitivity for the interruption of the rotary movement and to ensure, on the other hand, that the device restores the rotary movement as soon as the trouble is eliminated, by returning the frame into the starting position, the premanent magnet actuating the magnetic switch at the end of the articulated rod.

In the accompanying drawings in which is shown one of various possible embodiments of the several features of the invention.

Figure 1:
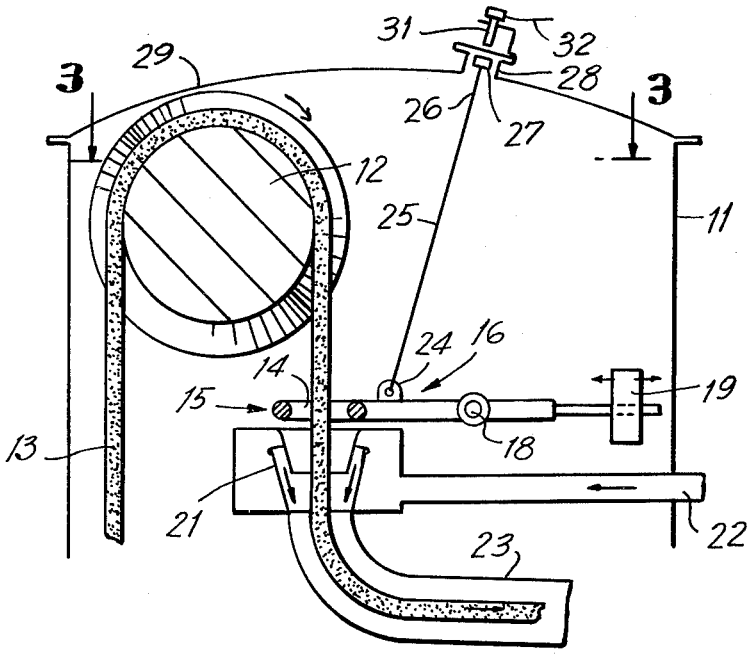
FIG. 1 is a diagrammatic side elevation view of the apparatus in normal running condition.

Referring now to the drawings, as shown in FIG. 1, a tank 11 is provided, having a driven guide roller 12 over which rides a textile web 13 moving in the direction of the arrow.

The web 13 passes through with clearance, the opening 14 in a frame 15 i.e., the web 13 normally does not engage the frame 15.

The frame 15 is mounted at the end of a lever 16 which is pivotally mounted on an axle 17 supported by bearings 18. The lever 16 on the side thereof opposed to frame 16 carries a displaceable weight 19.

Positioned beneath frame 15 is a ring nozzle 21 supplied with liquid under pressure through conduit 22, a guide tube 23 being associated with the ring nozzle 21 for further transportation of the textile web 13.

Pivotally connected to lever 16 as at 24 is one end of a rod 25 the free end 26 of which carries a permanent magnet 27 positioned in a guide 28 formed on the top wall 29 of tank 11.

The top wall 29 also supports a contact-free magnetic switch 31 which opens and closes a circuit 32 for the drive (not shown) of guide roller 12.

In the normal movement of the web 12, the lever 16 is in horizontal position as shown in FIG. 1, so that the web 12 passes through the opening 14 in frame 15 without touching the latter.

Figure 2:
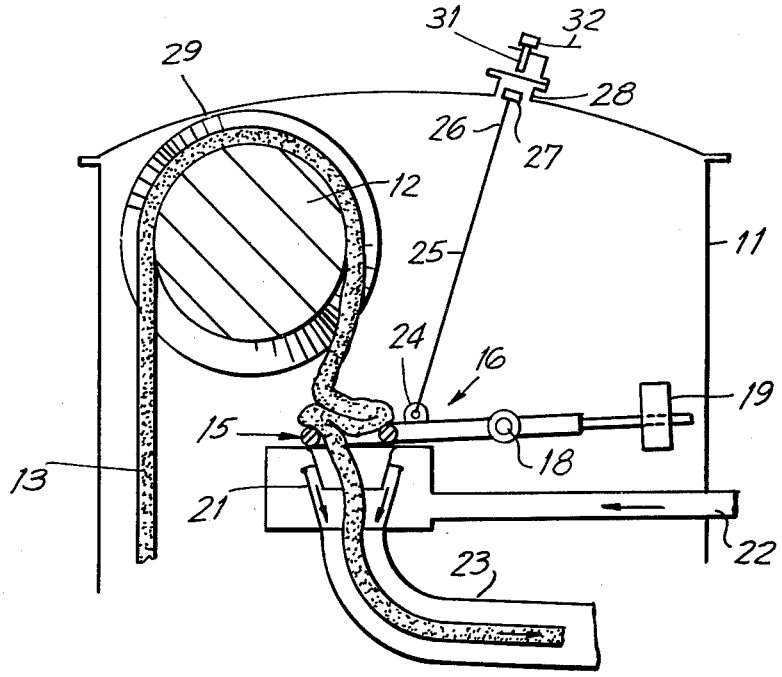
FIG. 2 is a view similar to FIG. 1 showing the apparatus with the drive roller deenergized.
Figure 3:
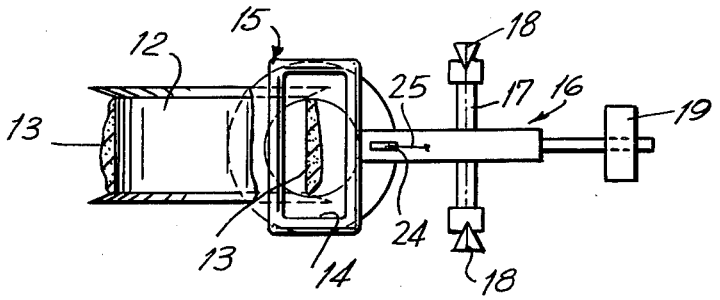
FIG. 3 is a top plan view taken along line 3 — 3 of FIG. 1.

If there is any trouble in the normal movement of web 12, the web 12 will accumulate above frame 15 as shown in FIG. 2, so that due to the weight of such accumulated web, the lever 14 will pivot in a counterclockwise direction about its pivots 18. At the same time the rod 25 will be pulled downwardly moving the permanent magnet 27 away from switch 31 so that the circuit 32 for the drive for roller 12 will be interrupted.

As a result of such interruption of the drive of roller 12, no further accumulation of the textile web will occur. Consequently, the force of the liquid flowing through conduit 22 will cause the web 12 to move through the guide tube 22 to eliminate the accumulation of the textile web 12, shown in FIG. 2.

When such an accumulation of textile web 12 is eliminated, the lever 16 will pivot back to its normal horizontal position shown in FIG. 1 due to the relief of the weight on the frame 15. Thereupon the magnet 27 will be moved by rod 25 into juxtaposition to switch 31 to close the circuit 32 so that the drive for roller 12 will be actuated and normal feed of web 12 will again commence.

It is to be noted that by adjusting the position of the weight 19, different amounts of accumulations of web 12 can be accommodated before the drive for roller 12 is cut off.

The apparatus above described insures the automatic interruption of the rotary movement of the drive roller 12 in case of trouble and ensures that an accumulation of the textile web 13 which interferes with normal movement thereof will quickly be eliminated and the roller drive will automatically resume as soon as the accumulation is eliminated.

Having thus described my invention what I claim is new and desire to secure by Letters Patent of the United States is:

1. Apparatus for automatically interrupting the movement of a textile web in a processing tank when said web accumulates in said tank, comprising a roller, drive means for said roller, said web passing over said roller for advance thereof, a frame on which the accumulated web will bear and having an opening through which the web passes, a lever pivoted between its ends, said frame being supported by one end of said lever, a ring nozzle positioned beneath said frame and aligned with the opening therein, a guide tube associated with said ring nozzle, said web passing through said ring nozzle and said guide tube, means to provide flow of liquid under pressure into said ring nozzle and said tube to advance said web through said tube, a switch in circuit with said drive means and means operatively connecting said lever to said switch to open the latter and break the circuit to the drive means for said roller when said lever is pivoted by the accumulation of web thereon.

2. The apparatus described in claim 1 in which means are provided to vary the pivoted movement of said lever.

3. The apparatus described in claim 1, in which an adjustable weight is provided at the other end of said lever remote from the end thereof by which the frame is supported, said weight being movable longitudinally of said lever to vary the pivotal movement of said lever.

4. The apparatus described in claim 1 in which a rod is pivotally connected at one end to said lever, the other end of said rod being operatively connected to said switch to open said circuit when said lever is pivoted.

5. The apparatus described in claim 4 in which said switch is a magnetic switch and the other end of said rod carries a permanent magnet movable toward and away from said switch as said lever is pivoted to control said switch.

* * * * *